United States Patent [19]

Marshall

[11] 4,389,456

[45] Jun. 21, 1983

[54] STABILIZED FINISH COMPOSITION

[75] Inventor: Robert M. Marshall, Chester, Va.

[73] Assignee: Allied Corporation, Morris Township, Morris County, N.J.

[21] Appl. No.: 316,584

[22] Filed: Oct. 30, 1981

[51] Int. Cl.[3] ..... D02G 3/00

[52] U.S. Cl. ..... 428/375; 8/115.6; 252/8.7; 427/389.9

[58] Field of Search ..... 252/8.7; 427/389.9; 8/115.6; 428/375

[56] References Cited

U.S. PATENT DOCUMENTS

| | | | |
|---|---|---|---|
| 2,798,044 | 7/1957 | Vitalis | 252/8.7 |
| 3,781,202 | 12/1973 | Marshall et al. | 252/8.7 |
| 3,997,450 | 12/1976 | Steinmiller | 252/8.7 |
| 4,192,754 | 3/1980 | Marshall et al. | 252/8.7 |

*Primary Examiner*—Norman Morgenstern

*Assistant Examiner*—Janyce A. Bell

*Attorney, Agent, or Firm*—Virginia S. Andrews

[57] ABSTRACT

An oil-in-water yarn finish composition, a process for treating yarn therewith and yarn so treated are all disclosed. The finish composition may be applied as a spin finish and/or overfinish to the yarn, preferably the latter. The nonaqueous portion of the composition comprises transesterified high oleic oil and high lauric oil; polyoxyalkylene castor oil; triglycerol monooleate and/or triglycerol dioleate; decaglycerol tetraoleate and/or decaglycerol pentaoleate; 4,4' butylidene-bis(6-tert-butyl-m-cresol); and an emulsion stabilizer selected from the group consisting of a salt of dialkyl sulfosuccinate neat wherein each alkyl group comprises 8 to 18 carbon atoms, a salt of dialkyl sulfosuccinate in solution or mixture wherein each alkyl group comprises 9 to 18 carbon atoms, and a mixture of a salt of dioctyl sulfosuccinate and a salt of an aromatic carboxylic acid.

49 Claims, No Drawings

STABILIZED FINISH COMPOSITION

BACKGROUND OF THE INVENTION

1. Field of the Invention

The present invention relates to a yarn finish composition, a process for treating yarn therewith and yarn so treated. More particularly, the present invention relates to an oil-in-water finish composition for application to polyester, preferably polyethylene terephthalate, yarn as a spin finish and/or overfinish. When used as a spin finish, the composition is essentially non-fuming. The general term yarn is used herein to include a variety of filamentary forms, for example filaments, fiber, thread, yarn in the form of cord, or other similar forms. Preferred use is in the construction of pneumatic tires or other reinforced rubber goods.

2. Description of the Prior Art

The prior art is replete with oil-in-water finish compositions or emulsions proposed for use with synthetic yarn during or subsequent to its formation. Many of the prior art finish emulsions flash off or fume during high temperature processing such as steam jet texturing or steam jet drawing. Others fail to have emulsion stability for a satisfactory period of time, as evidenced by creaming of the emulsion, i.e., separation of the oil and water. Application of a separated emulsion to yarn, especially via a kiss roll, causes uneven application of the emulsion oils which results in nonuniform yarn.

These problems are overcome by the stable finish composition of the present invention which has a non-fuming propensity both during production of the yarn and in subsequent processing. The finish components on the yarn are resistant to heat treatment at temperatures as high as 250° C. See for example, U.S. Pat. No. 3,687,721 to Dardoufas, hereby incorporated by reference.

SUMMARY OF THE INVENTION

The present invention provides an oil-in-water yarn finish composition, a process for treating yarn therewith and yarn so treated. The present invention also provides a method for improving the emulsion stability of an oil-in-water yarn finish composition.

It is preferred that the composition be an emulsion of water and about 15 to 40, most preferably 30, percent by weight of a nonaqueous portion which comprises:

(a) about 0.25 to 10, more preferably 1 to 5, weight percent of an emulsion stabilizer selected from the group consisting of a salt of dialkl sulfosuccinate neat wherein each alkyl group comprises 8 to 18 carbon atoms, more preferably 8 to 13 carbon atoms, and most preferably 8 carbon atoms; a salt of dialkyl sulfosuccinate in solution or mixture wherein each alkyl group comprises 9 to 18 carbon atoms, more preferably 9 to 13 carbon atoms, most preferably 9 carbon atoms; and a mixture of a salt of dioctyl sulfosuccinate and a salt of an aromatic carboxylic acid; and (b) the balance comprising:

about 55 to 60, most preferably 57, weight percent of a lubricant comprising transesterified high lauric oil and high oleic oil;

about 15 to 28, more preferably 18 to 25, weight percent of polyoxyalkylene castor oil;

about 4 to 15, more preferably 5.5 to 12.5, weight percent selected from the group consisting of triglycerol monooleate, triglycerol dioleate and mixtures thereof;

about 7 to 12, more preferably 8 to 10, weight percent selected from the group consisting of decaglycerol tetraoleate, decaglycerol pentaoleate and mixtures thereof; and about 1 to 5, most preferably 3, weight percent of a suitable antioxidant, preferably 4,4' butylidene-bis(6-tert-butyl-m-cresol), known commercially under the trademark SANTOWHITE® Powder and available from Monsanto Company, St. Louis, Mo.

With respect to the lubricant, by a "high" lauric oil is meant one which contains at least about 40 percent lauric groups, and by a "high" oleic oil is meant one which includes at least about 60 percent oleic groups. Transesterification of the high lauric oil and the high oleic oil may be accomplished by any known manner. The method of manufacture is well known in the industry, such as is disclosed in "Bailey's Industrial Oil and Fat Products" Third Edition, pages 958–964 (1964), hereby incorporated by reference. By a transesterified high lauric oil and high oleic oil is intended both the product of a transesterification of the high lauric oil and the high oleic oil and also the same or a similar product produced by means other than transesterification. A lubricant may include from about 10 to about 90 percent high lauric oil and from about 10 to about 90 percent high oleic oil. Examples of high oleic oils would include glycerol trioleate, olive oil, peanut oil, selectively hydrogenated soybean oil and combinations thereof. Examples of high lauric oils would include coconut oil, palm kernel oil and combinations thereof. The lubricant preferably comprises transesterified coconut oil and glycerol trioleate, the product comprising approximately 50 percent glycerol trioleate and approximately 50 percent coconut oil.

The polyoxyalkylene castor oil is preferably polyoxyethylene castor oil wherein there preferably are 16 to 33, more preferably 25 to 30, most preferably 25 or 26, moles of ethylene oxide per mole of castor oil. The alkylene oxide used, however, could be propylene oxide or the butylene oxides as well as ethylene oxide.

For the emulsion stabilizer, the preferred salt of dialkyl sulfosuccinate neat is sodium dioctyl sulfosuccinate. The preferred mixture of a salt of dioctyl sulfosuccinate and a salt of an aromatic carboxylic acid is a mixture of sodium dioctyl sulfosuccinate and sodium benzoate; the aromatic carboxylic acid could also be, for example, naphthalic acid. The preferred salt of dialkyl sulfosuccinate in solution or mixture is a solution of sodium dinonyl sulfosuccinate, propanol and water. Although the examples to follow are limited to inclusion of the sodium salts of dialkyl esters of sulfosuccinic acid or the sodium salt of an aromatic carboxylic acid, the salts useful in this invention are the ammonium and alkali metal salts, particularly sodium and potassium, with the sodium salts being most preferred.

In the most preferred composition, the emulsion stabilizer is a solution of sodium dinonyl sulfosuccinate, and the balance of the nonaqueous portion of the composition comprises: 57 weight percent transesterified coconut oil and glycerol trioleate; 25 weight percent polyoxyethylene castor oil having 25 or 26 moles of ethylene oxide per mole of castor oil; 5.5 weight percent of a mixture of triglycerol monooleate and triglycerol dioleate; 9.5 weight percent of decaglycerol tetraoleate;

and 3 weight percent of 4,4'-butylidene-bis(6-tert-butyl-m-cresol).

The finish composition is readily prepared in one of two ways. The lubricant, emulsifiers and antioxidant, i.e., the balance of the nonaqueous portion, may be mixed together and the blend cleared with a small amount of water. The emulsion stabilizer can then be added to the resultant composition, and the remaining water is added subsequent thereto. Alternatively, the emulsion stabilizer can be added with the balance of the nonaqueous portion, preferably last, prior to the addition of any water (other than the small amount which may be present in the emulsion stabilizer). In either case, the lubricant and emulsifiers may suitably be heated to dissolve the antioxidant, but this is not necessary. The preferred method of preparing the composition of the present invention is as follows: the lubricant is heated to from about 98° to 122° C. (210° to 250° F.), and the antioxidant (SANTOWHITE® Powder) is added slowly under agitation; the emulsifiers are then added as the blend cools to about 48.9° C. (120° F.), and a low amount of water is added (if necessary) to obtain a crystal clear blend at room temperature. Typically, the amount of water necessary to clear the blend is from about 5.0 to about 12.5, preferably about 10, weight percent. The emulsion stabilizer is preferably added at room temperature to the blend. To prepare the aqueous emulsion for use, it is preferred that the blend, including the emulsion stabilizer, and the necessary amount of water be added to one another at room temperature. The water is agitated, and the necessary amount of blend is quickly added. The agitation should be such that aeration does not occur. The mass should be stirred for at least 15 minutes to ensure adequate dispersion of the blend. Biocides or other additives may be added immediately after the blend is introduced. Dyes used as tinting agents for identification purposes should be added to the water and stirred until complete dispersion or dissolution of the dye is obtained prior to the introduction of the blend. The pH of the emulsion can be adjusted to the required degree dependent upon the pH of subsequent treatment systems, e.g., a subsequent latex dip system, to be used. If an adhesion promoter is utilized in the emulsion, it is preferred that it be added subsequent to the biocide. A less preferred way of preparing the aqueous emulsion for use is to warm the blend to 37.8° C. (100° F.), thoroughly mix the blend, heat the necessary amount of water to 48.9° C. (120° F.), and continue in the manner described above.

The improvement in a process for the production of synthetic polymer yarn comprises treating the yarn with a sufficient amount of the oil-in-water yarn finish composition described above to achieve a total oil on yarn of 0.1 to 2.0 weight percent. The finish composition may be used as a spin finish during spinning of the yarn and/or as an overfinish subsequent to drawing. The spinning and drawing processes may be either coupled or uncoupled, preferably the former. When used as a spin finish, the treating amount of finish composition is sufficient to achieve a total oil on yarn of 0.05 to 0.8 weight percent. When used as an overfinish, the treating amount of finish composition is sufficient to achieve a total oil on yarn of 0.05 to 1.2 weight percent.

The method for improving the emulsion stability of an oil-in-water yarn finish composition, the nonaqueous portion of which comprises the balance of the nonaqueous portion of the above-described finish composition, is to add 0.25 to 10 percent, based on the weight of the final nonaqueous portion of the composition, of an emulsion stabilizer as previously described.

Emulsion stability is determined by measuring the percent light transmittance of a particular oil-in-water finish composition as compared to water (100 percent light transmittance)-the smaller the oil particle size, the greaer the light transmittance, which results in better emulsion stability. The instrument utilized is the Beckman DK-2A (Beckman Instruments), a UV-visible spectrophotometer read at 735 nanometers.

DESCRIPTION OF THE PREFERRED EMBODIMENT

The yarns of this invention can be processed by any spin-draw process or spinning and separately drawing process available to the art and the patent and technical literature, using any suitable polyamide or polyester. The preferred polyesters are the linear terephthalate polyesters, i.e., polyesters of a glycol containing from 2 to 20 carbon atoms and a dicarboxylic acid component containing at least about 75 percent terephthalate acid. The remainder, if any, of the dicarboxylic acid component may be any suitable dicarboxylic acid such as sebacic acid, adipic acid, isophthalic acid, sulfonyl-4,4'-dibenzoic acid, or 2,8-di-benzofuran-dicarboxylic acid. The glycols may contain more than two carbon atoms in the chain, e.g., diethylene glycol, butylene glycol, decamethylene glycol, and bis-1,4-(hydroxymethyl)cyclohexane. Examples of linear terephthalate polyesters which may be employed include poly(ethylene terephthalate), poly(butylene terephthalate), poly(ethylene terephthalate/5-chloroisophthalate) (85/15), poly(ethylene terephthalate/5[sodium sulfo]isophthalate) (97/3), poly(cyclohexane-1,4-dimethylene terephthalate), and poly(cyclohexane-1,4-dimethylene terephthalate/hexahydroterephthalate) (75/25).

Uneven application of yarn overfinish during production of polyethylene terephthalate multifilament yarn led to an investigation of the emulsion stability of the oil in water emulsion forming the base of the overfinish. The percent light transmittance for a variety of oil in water emulsions wherein the oil portion was added to the water at room temperature was measured. Results are presented in Table 1. Note that Sample 1 is the control. The percent light transmittance was measured approximately 24 hours after the emulsion was made. Samples 4, 10, 12, 13, 14 and 15 are considered part of the present invention. With the exception of the Sample 1 control, all other samples are deemed comparative.

TABLE 1

LIGHT TRANSMITTANCE DATA

| | Sample | | | | | | | | | | | | | | |
|---|---|---|---|---|---|---|---|---|---|---|---|---|---|---|---|
| Components | 1 | 2 | 3 | 4 | 5 | 6 | 7 | 8 | 9 | 10 | 11 | 12 | 13 | 14 | 15 |
| Control[1] | 100 | 95 | 95 | 97 | 95 | 95 | 95 | 95 | 95 | 95 | 97 | 95 | 95 | 95 | 95 |
| MONAWET MB-45[2] | — | 5 | — | — | — | — | — | — | — | — | — | — | — | — | — |
| MONAWET MM-80[3] | — | — | 5 | — | — | — | — | — | — | — | — | — | — | — | — |
| Doss[4] | — | — | — | 3 | — | — | — | — | — | — | — | — | — | — | — |
| AEROSOL OT-70-PG[5] | — | — | — | — | 5 | — | — | — | — | — | — | — | — | — | — |

TABLE 1-continued

| LIGHT TRANSMITTANCE DATA | | | | | | | | | | | | | | | |
|---|---|---|---|---|---|---|---|---|---|---|---|---|---|---|---|
| | Sample | | | | | | | | | | | | | | |
| Components | 1 | 2 | 3 | 4 | 5 | 6 | 7 | 8 | 9 | 10 | 11 | 12 | 13 | 14 | 15 |
| AEROSOL OTS[6] | — | — | — | — | — | 5 | — | — | — | — | — | — | — | — | — |
| Solution[7] | — | — | — | — | — | — | 5 | — | — | — | — | — | — | — | — |
| MONAWET MO-70E[8] | — | — | — | — | — | — | — | 5 | — | — | — | — | — | — | — |
| MONAWET MO-84R2W[9] | — | — | — | — | — | — | — | — | 5 | — | — | — | — | — | — |
| MONAWET MO-85P[10] | — | — | — | — | — | — | — | — | — | 5 | — | — | — | — | — |
| MONAWET MO-65-150[11] | — | — | — | — | — | — | — | — | — | — | 3 | — | — | — | — |
| Dnss[12] | — | — | — | — | — | — | — | — | — | — | — | 5 | — | — | — |
| NEKAL WS-25[13] | — | — | — | — | — | — | — | — | — | — | — | — | 5 | — | — |
| MONAWET MT-70[14] | — | — | — | — | — | — | — | — | — | — | — | — | — | 5 | — |
| MONAWET MT-80H2W[15] | — | — | — | — | — | — | — | — | — | — | — | — | — | — | 5 |
| Water | 234 | 234 | 234 | 234 | 234 | 234 | 234 | 234 | 234 | 234 | 234 | 234 | 234 | 234 | 234 |
| % Light Transmitted | 8.0 | 0 | 0 | 28.0 | 6.0 | 4.0 | 0 | 0 | 0 | 56.0 | 0 | 52.0 | 18.0 | 34.0 | 38.0 |
| Footnotes follow Table 1. | | | | | | | | | | | | | | | |

Footnotes to Table 1.

[1]Consisting of 57 percent coconut oil transesterified with glycerol trioleate, 25 percent POE(25) castor oil, 5.5 percent mixture of triglycerol monooleate and triglycerol dioleate, 9.5 percent decaglycerol tetraoleate, and 3 percent 4,4' butylidene-bis(6-tert-butyl-m-cresol).

[2]MONA Industries' trade name for solution consisting of 45 percent sodium diisobutyl sulfosuccinate and 55 percent water.

[3]MONA Industries' trade name for solution consisting of 80 percent sodium dihexyl sulfosuccinate, 5 percent isopropanol, and 15 percent water.

[4]Dioctyl sulfosuccinate, sodium salt.

[5]American Cyanamid's trade name for solution consisting of 70 percent sodium dioctyl sulfosuccinate, 16 percent propylene glycol, and 14 percent water.

[6]American Cyanamid's trade name for solution consisting of 70 percent sodium dioctyl sulfosuccinate and 30 percent petroleum distillate.

[7]Consisting of 75 percent sodium dioctyl sulfosuccinate, 10 percent isopropanol, and 15 percent water.

[8]MONA Industries' trade name for solution consisting of 70 percent sodium dioctyl sulfosuccinate, 11 percent ethanol and 19 percent water.

[9]MONA Industries' trade name for solution consisting of 84 percent sodium dioctyl sulfosuccinate and 16 percent propylene glycol.

[10]MONA Industries' trade name for 85 percent sodium dioctyl sulfosuccinate and 15 percent sodium benzoate in powdered form.

[11]MONA Industries' trade name for solution consisting of 65 percent sodium dioctyl sulfosuccinate and 35 percent aromatic solvent.

[12]Dinonyl sulfosuccinate, sodium salt.

[13]GAF's trade name for solution consisting of 75 percent sodium dinonyl sulfosuccinate, 10 percent isopropanol, and 15 percent water.

[14]MONA Industries' trade name for solution consisting of 70 percent sodium ditridecyl sulfosuccinate, 18 percent hexylene glycol and 12 percent water.

[15]MONA Industries' trade name for solution consisting of 80 percent sodium ditridecyl sulfosuccinate and 20 percent hexylene glycol.

EXAMPLE 1

A melt of polyethylene terephthalate was supplied at a rate of 70 pounds (31.8 kg) per hour per end and at a temperature of about 290° C. to the apparatus shown in FIGS. 1 and 2 of U.S. Pat. No. 4,251,481 to Hamlyn, hereby incorporated by reference. The molten polymer was fed by extruder 11 to spin pump 12 which fed spin block 13 containing a conventional spin pot as shown in FIG. 1 of U.S. Pat. No. 4,072,457 to Cooksey et al., hereby incorporated by reference. A split spinnerette designed for the simultaneous extrusion of two multifilament ends of 192 filaments each was utilized.

The two ends 14 and 15 of multifilament, continuous filament yarn passed downwardly from the spinnerette into a substantially stationary column of air contained in a heated sleeve 16, about 15 inches (38.1 cms) in height, the temperature of the sleeve itself being maintained at about 400° C. Yarn leaving heated sleeve 16 was passed directly into the top of the quench chamber of quenching apparatus 17. Quenching apparatus 17 was as shown in FIG. 1C of U.S. Pat. No. 3,999,910 to Pendlebury et al., hereby incorporated by reference. Quenching air at about 18.3° C. (65° F.) and 60 percent relative humidity was supplied to cross flow quench the filaments as they descended through the quench chamber. The ends 14 and 15 of yarn were lubricated by finish applicator 18 and then separated and converged by guides 19. The spin finish comprised 40 parts mineral oil having a viscosity of 38–40 SUS and a boiling range between 266° and 327° C.; 15 parts refined coconut oil; 15 parts isohexadecyl stearate; 5 parts polyoxyethylene (20) tallow amine; 13 parts polyoxyethylene (4) lauryl ether; 10 parts sodium salt of aklylarylsulfonate; and 2 parts NEKAL WS-25 (see Table 1, footnote 13). A sufficient amount (approximately 0.45 percent wet pickup) of the finish composition was applied to the yarn to achieve about 0.2 percent, based on the weight of the yarn, on the yarn. See U.S. Pat. No. 3,672,977 to Dardoufas, hereby incorporated by reference. The ends were then transported via interfloor tube and aspirator 20 to the spin draw panel 21 where they were fed to wrap around a pretension roll 23 and accompanying separator roll 23*a* and then to feed roll 24 and accompanying separator roll 24*a*. Both sets of rolls were at a temperature of less than 50° C. From feed roll 24, the ends were then passed through conventional steam impinging draw point localizing jet 25, supplying steam at a temperature of 450° C. and at a pressure of 80 psig (552 kPa), and then to a pair of draw rolls 26 and 26*a*, one of which was maintained at about 130° C. The draw ratio was about 6.0 to 1. The ends passed from draw roll 26 to a pair of relax rolls 27 and 27*a*, the relax rolls 27 and 27*a* being heated to about 140° C. The yarn ends then passed through a conventional air operated interlacing jet 28 and were subsequently wound up.

To this drawn yarn was applied an overfinish made according to the preferred method previously outlined and utilizing the Sample 13 components (Table 1). A biocide (6-acetoxy-2,4-dimethyl-m-dioxane) was added to these components followed by the addition of an adhesion promoter, gamma-glycidoxypropyltrimethoxysilane. The biocide was added in an amount sufficient to form 0.1 percent of the final emulsion. The ratio of the silane to the other components was 5.25 parts to 94.75 parts. The overfinish was applied in an amount sufficient to achieve a total oil on yarn of about 1.0 to 1.2 percent and about 0.1 percent of silane on the yarn. Application of the overfinish (via contact with a roll rotating in a trough of overfinish) was even and smooth.

The yarn was subsequently twisted to make a 3-ply cord in known manner, and the cords were treated with a conventional, non-ammoniated resorcinol-formaldehyde-latex dip comprising vinyl pyrridine latex, resorcinol, formaldehyde, sodium hydroxide and water. Subsequent thereto, the cords were dried [e.g., in a first oven at 148° C. (300° F.) for 80 seconds, followed by a second oven at 241° C. (465° F.) for 60 seconds, at +1% stretch] and introduced to a rubber compound. This green rubber was cured in a mold, and strips thereof tested in accordance with the strip adhesion test defined in U.S. Pat. No. 3,940,544 to Marshall et al., hereby incorporated by reference, and modified to make strips having 40 ends per inch (15.7 ends per cm) rather than 20 ends per inch (7.8 ends per cm). There were no adverse affects on adhesion.

EXAMPLE 2

The procedure of Example 1 was repeated utilizing the overfinish composition as the spin finish to achieve a final oil on yarn of about 0.79 percent. There was no application of an overfinish. There were no adverse affects on adhesion.

EXAMPLE 3

The procedure of Example 1 was repeated with the following changes. The overfinish did not include an adhesion promoter, i.e., the gamma-glycidoxypropyltrimethoxysilane was omitted. After the yarn was twisted into 3-ply cord, the cord was treated with a conventional, blocked diisocyanate dip comprising Hylene MP [E. I. duPont de Nemours, Incorporated's trade name for bisphenol adduct of methylene bis(4-phenyl isocyanate)], Epon 812 (Shell Chemical Company's trade name glycerin epichlorohydrin resin), Aerosol OT (American Cyanamid's trade name for sodium dioctyl sulfosuccinate), gum tragacanth and water. The cords were dried in a first oven at 148° C. (300° F.) for 80 seconds, followed by a second oven at 227° C. (440° F.) for 40 seconds at +1% stretch. The resorcinol-formaldehyde-latex dip was ammoniated, and subsequent to treatment therewith, the cords were dried in a first oven at 148° C. (300° F.) for 80 seconds, followed by a second oven at 216° C. (420° F.) for 60 seconds, at −1% stretch. The yarn processed well and had acceptable product qualities, e.g. adhesion.

EXAMPLE 4

The procedure of Example 3 is repeated utilizing the overfinish composition as the spin finish to achieve a final oil of yarn of about 0.8 percent. There is no application of an overfinish. The yarn processes well and has acceptable product quantities.

What is claimed is:

1. An oil-in-water yarn finish composition, the nonaqueous portion of which comprises:

(a) about 0.25 to 10 weight percent of an emulsion stabilizer selected from the group consisting of a salt of dialkyl sulfosuccinate neat wherein each alkyl group comprises 8 to 18 carbon atoms, a salt of dialkyl sulfosuccinate in solution or mixture wherein each alkyl group comprises 9 to 18 carbon atoms, and a mixture of a salt of dioctyl sulfosuccinate and a salt of an aromatic carboxylic acid; and (b) the balance comprising:

about 55 to 60 weight percent of a lubricant comprising transesterified lauric oil and oleic oil, the lauric oil containing at least about 40 percent lauric groups and the oleic oil containing at least about 60 percent oleic groups; about 15 to 28 weight percent of polyoxyalkylene castor oil; about 4 to 15 weight percent selected from the group consisting of triglycerol monooleate, triglycerol dioleate and mixtures thereof; about 7 to 12 weight percent selected from the group consisting of decaglycerol tetraoleate, decaglycerol pentaoleate and mixtures thereof; and about 1 to 5 weight percent of a suitable antioxidant.

2. The composition of claim 1 wherein the emulsion stabilizer is present in the amount of about 1 to 5 weight percent.

3. The composition of claim 1 wherein the emulsion stabilizer is a salt of dialkyl sulfosuccinate neat wherein each alkyl group comprises 8 to 13 carbon atoms.

4. The composition of claim 3 wherein the emulsion stabilizer is a salt of dioctyl sulfosuccinate.

5. The composition of claim 1 wherein the emulsion stabilizer is a mixture comprising 85 percent a salt of dioctyl sulfosuccinate and 15 percent a benzoate salt.

6. The composition of claim 1 wherein the emulsion stabilizer is a salt of dialkyl sulfosuccinate in solution or mixture wherein each alkyl group comprises 9 to 13 carbon atoms.

7. The composition of claim 6 wherein the emulsion stabilizer is a solution comprising a salt of dinonyl sulfosuccinate, propanol and water.

8. The composition of claim 7 wherein the emulsion stabilizer is present in the amount of 1 to 5 weight percent.

9. The finish composition of claim 1 wherein the oleic oil of the lubricant is selected from the group consisting of glycerol trioleate, olive oil, peanut oil, selectively hydrogenated soybean oil and combinations thereof.

10. The composition of claim 1 wherein the antioxidant comprises 4,4'butylidene-bis(6-tert-butyl-m-cresol).

11. The composition of claim 1 wherein the lauric oil of the lubricant is selected from the group consisting of coconut oil, palm kernel oil and combinations thereof.

12. The composition of claim 11 wherein the oleic oil of the lubricant is selected from the group consisting of glycerol trioleate, olive oil, peanut oil, selectively hydrogenated soybean oil and combinations thereof.

13. The composition of claim 12 wherein the lauric oil is coconut oil.

14. The composition of claim 13 wherein the oleic oil is glycerol trioleate.

15. The composition of claim 14 wherein the lubricant includes about 10 to 90 percent coconut oil and about 10 to 90 percent glycerol trioleate.

16. The composition of claim 1 wherein the nonaqueous portion comprises approximately 15 to 40 percent by weight of said composition.

17. A polyester yarn having incorporated therewith the composition of claim 1.

18. The composition of claim 1 wherein the emulsion stabilizer is a salt of dioctyl sulfosuccinate neat, and wherein the lubricant comprises transesterified coconut oil and glycerol trioleate with about 10 to 90 percent coconut oil and about 10 to 90 percent glycerol trioleate.

19. The composition of claim 18 wherein the antioxidant comprises 4,4'butylidene-bis(6-tert-butyl-m-cresol).

20. The composition of claim 19 wherein the emulsion stabilizer forms 1 to 5 weight percent of the nonaqueous portion and the 95–99 weight percent balance comprises:

57 weight percent lubricant;

18 to 25 weight percent polyoxyalkylene castor oil;

5.5 to 12.5 weight percent selected from the group consisting of triglycerol monooleate, triglycerol dioleate and mixtures thereof;

7 to 12 weight percent selected from the group consisting of decaglycerol tetraoleate, decaglycerol pentaoleate and mixtures thereof; and 3 weight percent antioxidant.

21. The composition of claim 20 wherein the nonaqueous portion comprises about 15 to 40 percent by weight of said composition.

22. A polyester yarn having incorporated therewith the composition of claim 20.

23. The composition of claim 1 wherein the emulsion stabilizer is a mixture of a salt of dioctyl sulfosuccinate and a benzoate salt, and wherein the lubricant comprises transesterified coconut oil and glycerol trioleate with about 10 to 90 percent coconut oil and about 10 to 90 percent glycerol trioleate.

24. The composition of claim 23 wherein the antioxidant comprises 4,4'butylidene-bis(6-tert-butyl-m-cresol).

25. The composition of claim 24 wherein the emulsion stabilizer forms 1 to 5 weight percent of the nonaqueous portion and the 95 to 99 weight percent balance comprises:

57 weight percent lubricant;

18 to 25 weight percent polyoxyalkylene castor oil;

5.5 to 12.5 weight percent selected from the group consisting of triglycerol monooleate, triglycerol dioleate and mixtures thereof;

7 to 12 weight percent selected from the group consisting of decaglycerol tetraoleate, decaglycerol pentaoleate, and mixtures thereof; and 3 weight percent antioxidant.

26. The composition of claim 25 wherein the nonaqueous portion comprises about 15 to 40 percent by weight of said composition.

27. A polyester yarn having incorporated therewith the composition of claim 25.

28. The composition of claim 1 wherein the emulsion stabilizer is a solution comprising a salt of dinonyl sulfosuccinate, propanol and water, and wherein the lubricant comprises transesterified coconut oil and glycerol trioleate with about 10 to 90 percent coconut oil and 10 to 90 percent glycerol trioleate.

29. The composition of claim 28 wherein the antioxidant comprises 4,4'butylidene-bis(6-tert-butyl-m-cresol).

30. The composition of claim 29 wherein the emulsion stabilizer forms 1 to 5 weight percent of the nonaqueous portion and the 95 to 99 weight percent balance comprises:

57 weight percent lubricant;

18 to 25 weight percent polyoxyalkylene castor oil;

5.5 to 12.5 weight percent selected from the group consisting of triglycerol monooleate, triglycerol dioleate and mixtures thereof;

7 to 12 weight percent selected from the group consisting of decaglycerol tetraoleate, decaglycerol pentaoleate, and mixtures thereof; and 3 weight percent antioxidant.

31. The composition of claim 30 wherein the nonaqueous portion comprises about 15 to 40 percent by weight of said composition.

32. A polyester yarn having incorporated therewith the composition of claim 30.

33. In a process for the production of synthetic polymer yarn, the improvement which comprises: treating the yarn with a sufficient amount of an oil-in-water yarn finish composition to achieve a total oil on yarn of 0.1 to 2.0 weight percent, the nonaqueous portion of the composition comprising:

(a) about 0.25 to 10 weight percent of an emulsion stabilizer selected from the group consisting of a salt of dialkyl sulfosuccinate neat wherein each alkyl group comprises 8 to 18 carbon atoms, a salt of dialkyl sulfosuccinate in solution or mixture wherein each alkyl group comprises 9 to 18 carbon atoms, and a mixture of a salt of dioctyl sulfosuccinate and a salt of an aromatic carboxylic acid; and (b) the balance comprising: about 55 to 60 weight percent of a lubricant comprising transesterified lauric oil and oleic oil, the lauric oil containing at least about 40 percent lauric groups and the oleic oil containing at least about 60 percent oleic groups; about 15 to 28 weight percent of polyoxyalkylene castor oil; about 4 to 15 weight percent selected from the group consisting of triglycerol monooleate, triglycerol dioleate and mixtures thereof;

about 7 to 12 weight percent selected from the group consisting of decaglycerol tetraoleate, decaglycerol pentaoleate and mixtures thereof; and about 1 to 5 weight percent of a suitable antioxidant.

34. The process of claim 1 wherein the finish composition is a spin finish, and the treating step occurs during spinning of the yarn.

35. The process of claim 34 wherein the treating amount of finish composition is sufficient to achieve a total oil on yarn of 0.05 to 0.8 weight percent.

36. The process of claim 33 wherein the finish composition is an overfinish, and the treating step occurs subsequent to drawing of the yarn.

37. The process of claim 36 wherein the treating amount of finish composition is sufficient to achieve a total oil on yarn of 0.05 to 1.2 weight percent.

38. The process of claim 33 wherein the finish composition is a spin finish and an overfinish, and there are two treating steps, one occuring during spinning of the yarn and one occurring subsequent to drawing of the yarn.

39. A method for improving the emulsion stability of an oil-in-water yarn finish composition by adding thereto the nonaqueous portion which comprises:

about 55 to 60 weight percent of a lubricant comprising transesterified lauric oil and oleic oil, the lauric oil containing at least about 40 percent lauric groups and the oleic oil containing at least about 60 percent oleic groups, said lubricant including about 10 to 90 percent lauric oil and about 10 to 90 percent oleic oil;

about 15 to 28 weight percent of polyoxyalkylene castor oil; about 4 to 15 weight percent selected from the group consisting of triglycerol monooleate, triglycerol dioleate and mixtures thereof;

about 7 to 12 weight percent selected from the group consisting of decaglycerol tetraoleate, decaglycerol pentaoleate and mixtures thereof; and about 1 to 5 weight percent of a suitable antioxidant; said method comprising:

adding about 0.25 to 10 percent, based on the weight of the final nonaqueous portion of the composition, of an emulsion stabilizer selected from the group consisting of a salt of dialkyl sulfosuccinate neat wherein each alkyl group comprises 8 to 18 carbon atoms, a salt of dialkyl sulfosuccinate in solution or mixture wherein each alkyl group comprises 9 to 18 carbon atoms, and a mixture of a salt of dioctyl sulfosuccinate and a salt of an aromatic carboxylic acid.

40. The method of claim 39 wherein the emulsion stabilizer is present in the amount of about 1 to 5 percent, based on the weight of the final nonaqueous portion of the composition.

41. The method of claim 39 wherein the emulsion stabilizer is a salt of dialkyl sulfosuccinate neat wherein each alkyl group comprises 8 to 13 carbon atoms.

42. The method of claim 41 wherein the emulsion stabilizer is a salt of dioctyl sulfosuccinate.

43. The method of claim 42 wherein the salt is the sodium salt.

44. The method of claim 39 wherein the emulsion stabilizer is a mixture comprising 85 percent a salt of dioctyl sulfosuccinate and 15 percent benzoate salt.

45. The method of claim 44 wherein the salts are sodium salts.

46. The method of claim 39 wherein the emulsion stabilizer is a salt of dialkyl sulfosuccinate in solution or mixture wherein each alkyl group comprises 9 to 13 carbon atoms.

47. The method of claim 46 wherein the emulsion stabilizer is a solution comprising a salt of dinonyl sulfosuccinate, propanol and water.

48. The method of claim 47 wherein the solution consists essentially of 75 percent sodium dinonyl sulfosuccinate, 10 percent isopropanol and 15 percent water.

49. The method of claim 39 wherein the nonaqueous portion comprises about 15 to 40 percent by weight of said composition.

* * * * *